US009340262B1

(12) United States Patent
Boyd et al.

(10) Patent No.: US 9,340,262 B1
(45) Date of Patent: May 17, 2016

(54) INFLATABLE LAUNCH AND RECOVERY SYSTEM

(71) Applicant: Naval Undersea Warfare Center, Division, Newport, Newport, RI (US)

(72) Inventors: Scott D Boyd, Portsmouth, RI (US); Paul V Cavallaro, Raynham, MA (US); Alyssa A Cosmo, South Kingstown, RI (US); Donald E Cressman, Saunderstown, RI (US); Robert F Cutler, III, Tiverton, RI (US); Kurt M Czepizak, Tiverton, RI (US); Richard E Dooley, Portsmouth, RI (US); Ryan F Galego, Barrington, RI (US); Michael J Kroger, Middletown, RI (US); Geoffrey R Moss, Portsmouth, RI (US); Joseph M Muhitch, Exeter, RI (US); David B Segala, Tiverton, RI (US); Michael E Werbicki, South Kingstown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 6 days.

(21) Appl. No.: 14/447,698

(22) Filed: Jul. 31, 2014

(51) Int. Cl.
*B63B 21/56* (2006.01)
*B63B 21/16* (2006.01)
*B63B 27/36* (2006.01)

(52) U.S. Cl.
CPC ..... *B63B 21/56* (2013.01); *B63B 21/16* (2013.01); *B63B 27/36* (2013.01)

(58) Field of Classification Search
USPC ..... 414/139.2, 139.3, 139.5; 114/242, 243, 114/244, 249, 253, 254
See application file for complete search history.

(56) References Cited

U.S. PATENT DOCUMENTS 3,596,623 A * 8/1971 Frankel ..... B63B 27/143 114/259
3,811,534 A * 5/1974 Fisher ..... A62B 1/20 182/48
3,973,645 A 8/1976 Dix et al.
3,990,258 A * 11/1976 Ford ..... B63C 3/00 180/116
4,013,247 A 3/1977 Giffin
4,526,262 A 7/1985 Malcolm
4,990,114 A * 2/1991 LeBlanc, Jr. ..... B63C 9/32 14/27
5,094,181 A * 3/1992 Fuerst ..... B63C 7/10 114/54
5,253,605 A * 10/1993 Collins ..... B63B 21/66 114/258
5,360,186 A 11/1994 Danielson et al.
5,871,180 A 2/1999 Hublikar (Continued)

*Primary Examiner* — Paul T Chin
(74) *Attorney, Agent, or Firm* — James M. Kasischke; Michael P. Stanley

(57) ABSTRACT

An inflatable launch and recovery system for a towed body is provided. The system is containerized for ease of transport. A container houses a tow body, tow cable, a winch, winch controls, an inflatable ramp, deployment and retrieval equipment, power junctions and air line connections. Inflatable arch shaped tubes and spacer fabric form the ramp structure from which the tow body can be launched and recovered. The ramp can be ballasted to provide hydrodynamic stability and to provide sufficient system depth to accommodate retrieval of towed bodies operating below a liquid medium surface. Additional control can be achieved using inflatable or rigid fin elements or downward lifting surfaces. A rigid clamping fixture connects the ramp structure to the vessel. A snubber element dampens vibrations and transient tow loads.

10 Claims, 6 Drawing Sheets

(56) References Cited

U.S. PATENT DOCUMENTS 5,906,340 A * 5/1999 Duggal ..... B64D 25/14 182/48
6,190,222 B1 * 2/2001 Senger ..... B63C 9/32 441/82
6,536,715 B1 3/2003 Moran et al.
2002/0085883 A1 * 7/2002 Meyers ..... E02B 3/062 405/52
2008/0017096 A1 * 1/2008 Shepherd ..... B63B 23/48 114/365
2008/0145149 A1 * 6/2008 Grinsted ..... B63C 3/12 405/1
2008/0301888 A1 * 12/2008 Watchorn ..... B63B 21/00 14/71.1
2012/0227658 A1 * 9/2012 Chon ..... B63B 7/08 114/345

* cited by examiner

INFLATABLE LAUNCH AND RECOVERY SYSTEM

STATEMENT OF GOVERNMENT INTEREST

The invention described herein may be manufactured and used by or for the Government of the United States of America for governmental purposes without the payment of any royalties thereon or therefor.

This application claims the benefit of U.S. Provisional Patent Application No. 61/971,778; filed on Mar. 28, 2014 by the inventor, Scott Boyd et al. and entitled "INFLATABLE LAUNCH AND RECOVERY SYSTEM".

CROSS REFERENCE TO OTHER PATENT APPLICATIONS

None.

BACKGROUND OF THE INVENTION (1) Field of the Invention

The present invention relates to launch and recovery systems, and more particularly a lightweight, containerized, inflatable launch and recovery system for towed bodies.

(2) Description of the Prior Art

Various at-sea training exercises require the launch, tracking and recovery of undersea vehicles. Due to the high costs of such vehicles; it is imperative that precautions be taken to ensure that the vehicles are not lost during exercises. Through the use of a towed body, these exercises can simulate the launch and tracking of an undersea vehicle while enabling recovery of the vehicle at the conclusion of the exercise.

Launch and recovery systems for towed bodies used in undersea warfare exercises often require installations and infrastructures that are unique to the host vessel; especially when installed aboard research vessels. The specialized handling equipment used aboard research vessels lacks the adaptability required for their general use aboard multiple fleet platforms. The inability of the specialized handling equipment to readily support multiple platforms can limit fleet exercises. Furthermore, research vessels are typically unable to operate at fleet tactical speeds.

The systems in current use are generally vessel specific and rigid—often constructed of metal frames. These frames can take up considerable deck space that could otherwise be used for tactical operations. During exercises, the frames sometimes are subjected to overload events. As a result, the frames may permanently deform or fracture; thereby, rendering the frames inoperable.

What is therefore needed is a more flexible towed body launch and recovery system design that will enable deployment from a variety of fleet platforms. The system should be capable of operation at tactical speeds. Furthermore, a system is needed that provides a structurally fail-safe mode of operation during an overload event, i.e., an overload on the system should not cause major structural damage that shuts down the system.

There is also a need to minimize the deck space requirements of the launch and recovery system. In meeting these needs, the system should also reduce system installation costs and infrastructure requirements. Additionally, handling system weight, operational deployment times and retrieval times can also be reduced.

SUMMARY OF THE INVENTION

Accordingly, it is an object of the present invention to provide a towed body launch and recovery system that can be deployed from a variety of fleet platforms.

It is a further object of the present invention to provide a system capable of operation at tactical speeds.

It is a still further object of the present invention to provide a structurally fail-safe mode of operation in the event of an overload.

A still further object of the present invention is to minimize the deck space requirements of the towed body launch and recovery system. Additional objects are to provide a system that reduces system installation costs and infrastructure requirements.

In accordance with these and other objects made apparent hereinafter, an inflatable launch and recovery system for a towed body is provided. The launch and recovery system is lightweight and containerized for ease of transport and to provide a universal deck footprint. The system includes a standard shipping container that houses a tow body, tow cable, a winch and winch controls, an inflatable ramp, deployment and retrieval equipment fittings, power junctions and air line connections. The system also includes power electronics and software controllers.

Multiple, inflatable, arch shaped tubes and spacer fabric form the ramp structure from which the tow body can be launched and recovered. Trailing end sections of the inflatable ramp can be ballasted to provide hydrodynamic stability against sea state motions and vessel wakes. The trailing end sections also provide sufficient system depth below the surface to accommodate retrieval of towed bodies operating below the surface. Additional control can be achieved using inflatable or rigid fin elements or downward lifting surfaces.

Connection of the leading inflated section to the vessel is provided by using a rigid clamping fixture with an optionally integrated dynamic snubber element to dampen out vibrations and transient tow loads. The main air fill line from the handling system to the inflatable ramp can be ported through the clamping fixture.

In one embodiment, the launch and recovery system includes a handling system for the towed body, an inflatable ramp and a container housing the towed body, the handling system and the inflatable ramp when the ramp is in a deflated configuration. The towed body is attached to the handling system when the ramp is in the deflated configuration. The ramp is inflated and extends from an aft end of the container and into a liquid medium in a deployed configuration. The towed body is detached from the handling system and positioned on the ramp when the ramp is in the deployed configuration.

In one embodiment, the ramp is comprised of at least two tubular longitudinal sections and a flat panel longitudinal section connected between the tubular longitudinal sections. The towed body is positioned on the flat panel longitudinal section when the ramp is in the deployed configuration.

The tubular longitudinal sections and the flat panel longitudinal section can each include a plurality of compartmented volumes. The ramp structure can also include a plurality of fill lines with each fill line connected between an air supply and one of the volumes. Each volume can include a pressure relief valve. The container can include air and electric connections to respective air supply and electrical systems of a vessel on which the container is located.

In one embodiment, the system includes a first winch positioned within the container and a cable connected between the first winch and an aft end of the ramp. The cable is wound on the first winch when the ramp is in the deflated configuration such that the aft end of the ramp is proximate to the first winch. The cable is unwound and extends away from the container when the ramp is in the deployed configuration such that the aft end of the ramp is distant from the first winch.

In one embodiment, the system includes a second winch positioned within the container and a cable connected between the second winch and a forward end of the towed body. This cable is wound on the second winch when the towed body is attached to the handling system such that the towed body is proximate to the second winch. The cable is unwound and extends away from the container when the towed body is maneuvered down the ramp in the deployed configuration such that the towed body is distant from the second winch and the towed body is deployed into the liquid medium.

The system can also include a platform positioned within the container. A forward end of the ramp is connected to the platform. A snubber connection can be provided between the forward end of the ramp and the platform. The platform can be movably connected to the container using a series of sliding rails. The platform can be positioned at a forward end of the container when the ramp is in the deflated configuration. The platform can be positioned at the aft end of the container when the ramp is in the deployed configuration.

The second winch can be attached to the platform. The first winch also can be movably connected to the container. The first winch can be positioned at the forward end of the container when the ramp is in the deflated configuration. The first winch can be positioned at the aft end of the container when the ramp is in the deployed configuration.

In one embodiment, the system can include at least one ballast port in a trailing section of the ramp adjacent to the aft end of the ramp. The liquid medium can enter through the ballast port and into the ramp when the ramp is in the deployed configuration such that the aft end of the ramp is below a surface of the medium when in the deployed configuration. The aft end of the ramp can include a drain for the liquid medium from within the ramp. Additionally, the trailing section can include hydrodynamic control elements, inflatable or rigid fin elements, or downward lifting surfaces.

In one embodiment, the launch and recovery system can include a standardized shipping container and an inflatable ramp disposed within the container in a stowed configuration when the ramp is in a deflated state. One standard ISO (International Organization for Standardization) shipping container has dimensions of 8 feet wide by 8 feet high by 20 feet long. Other sizes are commercially available. The ramp can extend from the container and into a liquid medium in a deployed configuration when the ramp is in an inflated state. The towed body is disposed within the container in the stowed configuration. The towed body is maneuverable from the container, along the ramp and into the liquid medium in the deployed configuration.

In one embodiment, the ramp is comprised of at least two tubular longitudinal sections having a plurality of compartmented volumes. A flat panel longitudinal section is connected between the tubular longitudinal sections and the flat panel longitudinal section also has a plurality of compartmented volumes. The towed body is positioned on the flat panel longitudinal section in the deployed configuration. The ramp further includes a plurality of fill lines. Each fill line is connected between an air supply and one of the compartmented volumes.

In one embodiment, the system includes at least one ballast port in a trailing section of the ramp. The liquid medium enters through the ballast port and into the ramp in the deployed configuration such that an aft end of the ramp adjacent to the trailing section is below a surface of the medium in the deployed configuration. The aft end of the ramp also can include a drain for the liquid medium from within the ramp. Additionally, the trailing section can include hydrodynamic control elements, an inflatable or rigid fin elements, or downward lifting surfaces.

Other objects, features and advantages of the present invention including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent, wherein corresponding reference characters indicate corresponding parts throughout the several views of the drawings and wherein.

DETAILED DESCRIPTION OF THE INVENTION

Figure 1:
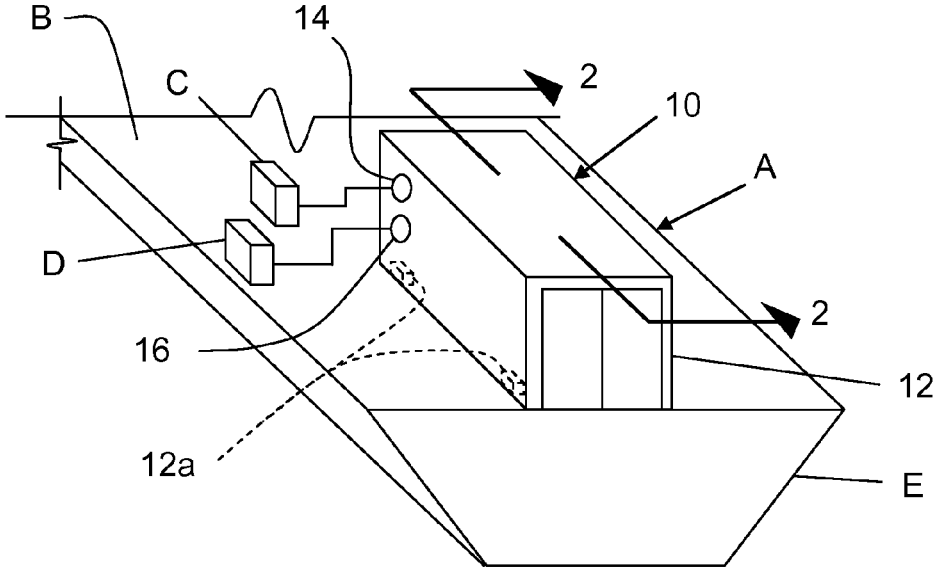
FIG. 1 is a schematic and isometric view of an inflatable launch and recovery system of the present invention.

Referring now to FIG. 1, there is shown a schematic and isometric view of inflatable launch and recovery system 10 mounted on vessel A (only partially shown in the figure). Housing 12 of the system 10 is a standard shipping container secured to deck B of the vessel A with standard container cam locks 12*a* (two of which are shown in phantom in FIG. 1). The system 10 can connect to a vessel power supply C via a power fitting 14. Similarly, the system 10 can connect to a vessel air supply D via an air fitting 16.

Figure 2:
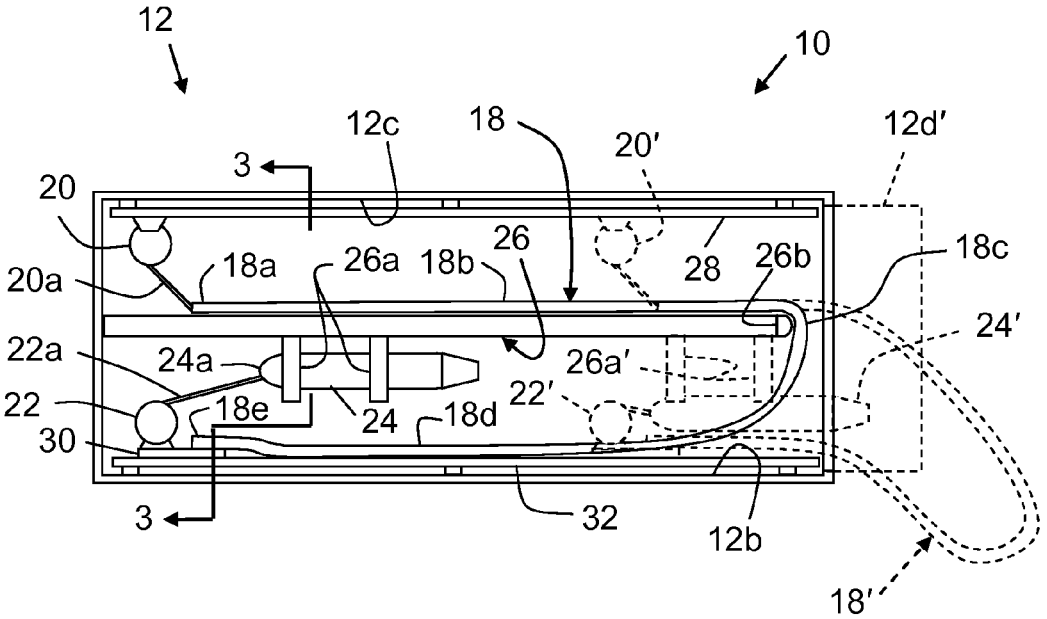
FIG. 2 is a schematic cross-sectional view of the system of FIG. 1, taken in the direction of line 2-2 in FIG. 1.

Referring also to FIG. 2, there is shown a cross-sectional view of the system 10, taken along a plane in the direction of line 2-2 of FIG. 1. For clarity of illustration, but not limitation, cross-hatching and vessel A are not shown in FIG. 2. In the stowed configuration shown in FIG. 2, the housing 12 encloses inflatable ramp 18, a pair of top winches 20 (one of which is shown in FIG. 2), a lower winch 22, a towed body 24 and a handling system 26. The towed body 24 is supported by cradles 26*a* of the handling system 26. Typically, the housing 12 is mounted at aft end E of the vessel A (as shown in FIG. 1), such that the inflatable ramp 18 of the system 10 can trail behind the vessel A when the ramp is deployed.

In the stowed position, the ramp 18 is mostly deflated. Cabling 20*a* from the top winch 20 connects to aft end 18*a* of the ramp 18. Rear section 18*b* of the ramp 18 is supported above the handling system 26. Mid-section 18*c* of the ramp 18 drapes over shaped end 26*b* of the handling system 26. The shaped end 26*b* allows the deflated ramp 18 to be drawn over the handling system 26 without damage to the ramp. Forward section 18*d* extends along a lower inner surface 12*b* of the container 12.

Figure 3:
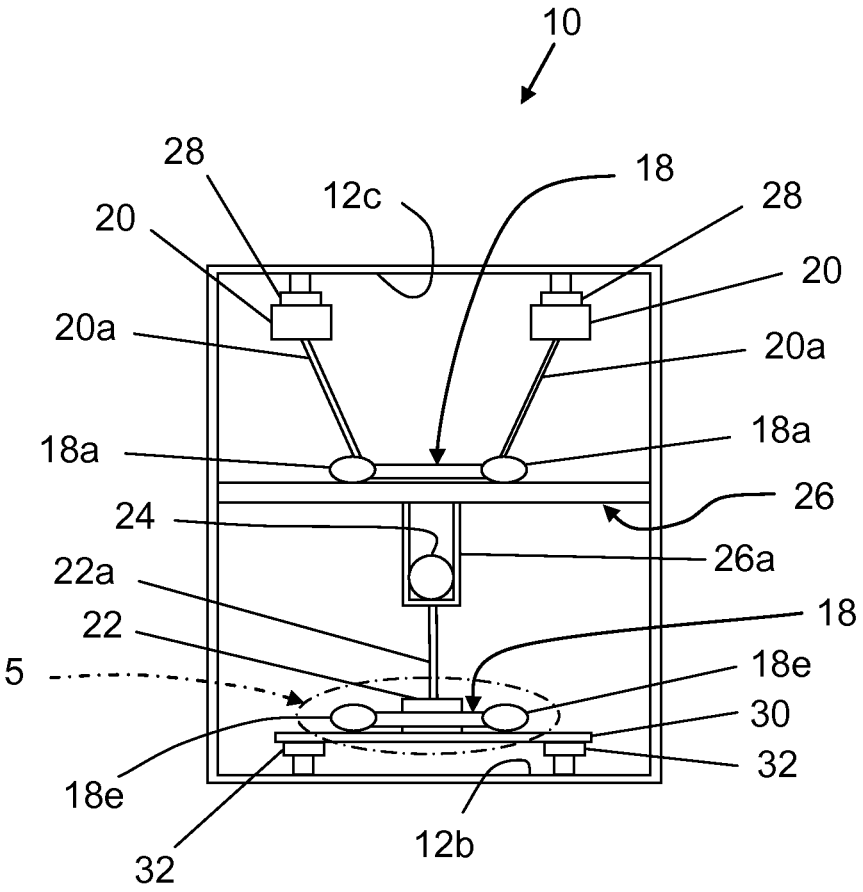
FIG. 3 is a schematic cross-sectional view of the system of FIG. 1, taken in the direction of line 3-3 in FIG. 2.

Referring also to FIG. 3, there is shown a cross-sectional view of the system 10, taken at reference line 3-3 of FIG. 2. For clarity of illustration, cross-hatching is not shown in FIG. 3. The top winches 20 are each mounted on one of a pair of top rails 28, running longitudinally (as shown in FIG. 2) along upper inner surface 12*c* of the container 12. The cabling 20*a* from each top winch 20 connects to the aft end 18*a* of the ramp 18. Platform 30 spans a pair of bottom rails 32, with the rails running longitudinally (also as shown in FIG. 2) along the lower inner surface 12*b* of the container 12. Forward end 18*e* of the ramp 18 is connected to the platform 30. The lower winch 22 is mounted on the platform 30 between the rails 32. Cabling 22*a* of the bottom winch 22 connects to forward end 24*a* of the towed body 24, which is supported by the cradle 26*a*.

Figure 4:
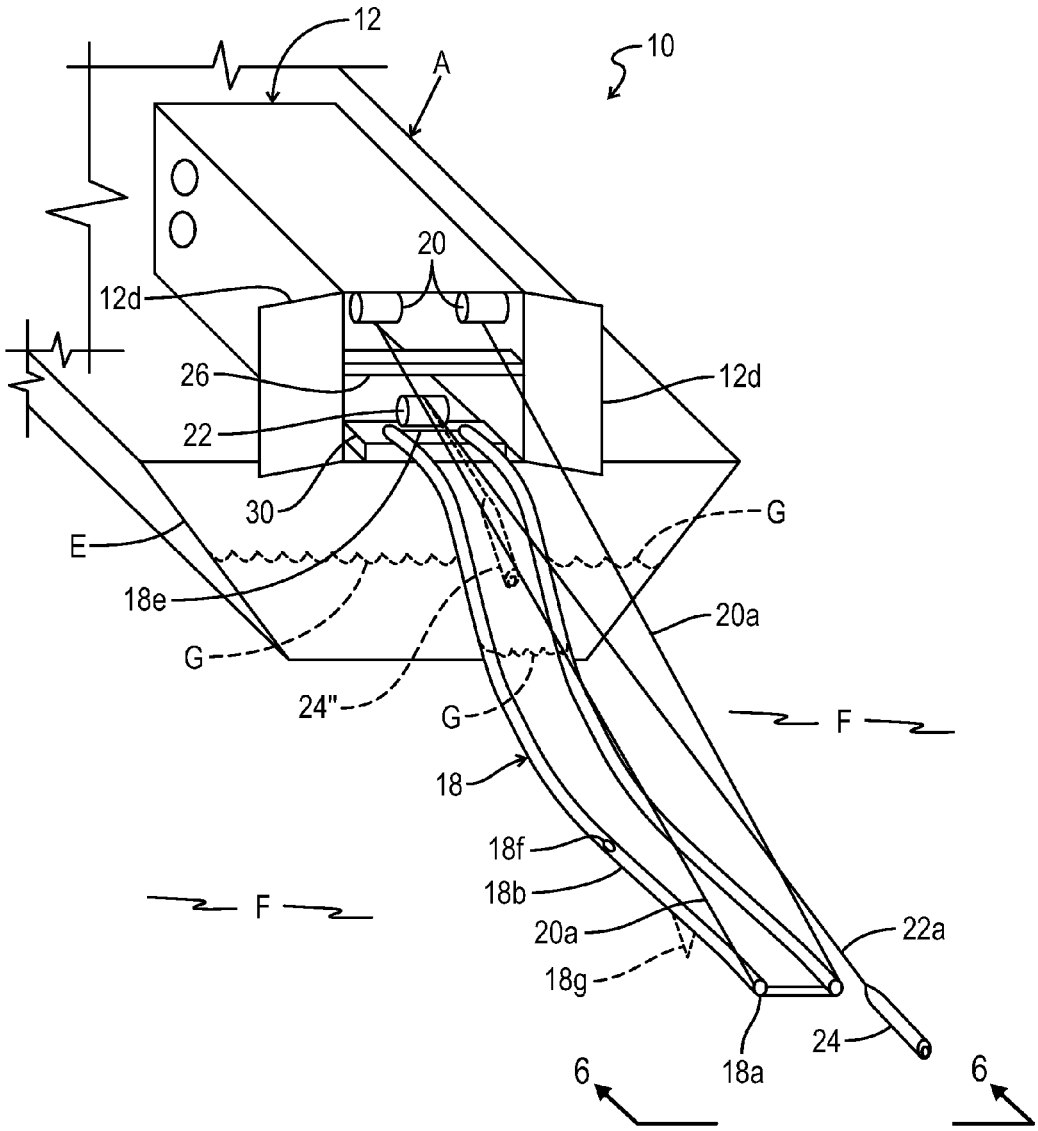
FIG. 4 is a schematic isometric view of the system of FIG. 1, in a deployed configuration.

Referring also to FIG. 4, there is shown a schematic isometric view of the system 10, with the system in a deployed configuration. During deployment, the top winches 20 and the platform 30 (together with the bottom winch 22) move toward open doors 12*d* along the respective top and bottom rails 28 and 32. As a result, the ramp 18 passes through the open doors 12*d* and extends from the housing 12 in a partially deployed configuration. Additionally, the handling system 26 moves the towed body 24 toward the open doors 12*d* and lowers the towed body onto the ramp 18.

For clarity of illustration, but not limitation, the top rail 28 and the bottom rail 32 are shown in FIG. 2, but not shown in FIG. 4. Also, the partially deployed configuration of the ramp 18' is shown in phantom in FIG. 2, with the top winches 20' and bottom winch 22' shown in a position closer to the open door 12*d'* and towed body 24' shown lowered from the cradle 26*a'* onto the ramp 18.

Figure 6:
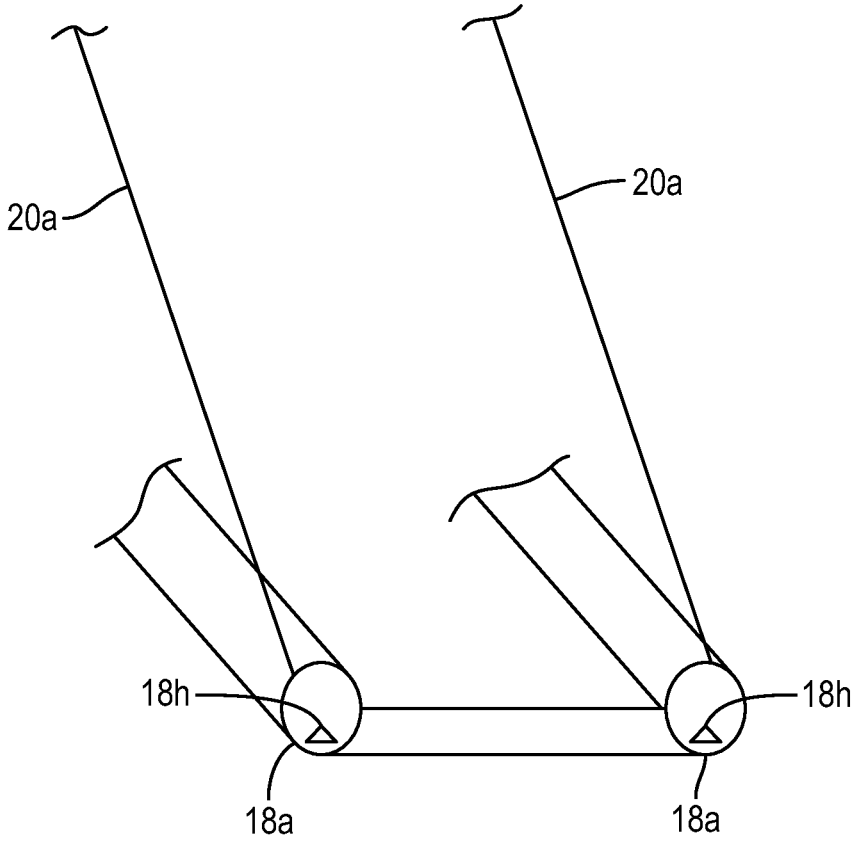
FIG. 6 is an enlarged, end view showing self-draining ballast ports of the system taken in the direction of line 6-6 in FIG. 4.

As the cabling 20*a* is unreeled from the top winches 20 and the ramp 18 is inflated; the rear section 18*b* extends to a fully deployed position into ocean F. The rear section 18*b* is ballasted so as to remain below surface G of ocean F, as shown in FIG. 4. (For clarity of illustration, but not limitation, surface G is denoted as wavy dotted lines against aft end E of vessel A and against the ramp 18.) Additionally, ballasting provides hydrodynamic stability against sea state motions and vessel wakes. Self-filling/drainage ballast ports 18*f* are provided in the rear section 18*b*. The rear section 18*b* is configured to drain automatically through self-filling/draining ballast ports 18*f* and the aft end self-draining ballast ports 18*h* (See FIG. 6 for detailed view of aft end ports). As described previously herein, forward end 18*e* of the ramp 18 is secured to the platform 30.

After the handling system 26 lowers the towed body 24 onto the ramp 18; the cradle 26*a* is removed (accordingly, not shown in FIG. 4). As the cabling 22*a* is let off the bottom winch 22, the towed body 24 begins descending down the ramp 18 (shown in phantom as 24" in FIG. 4), until the towed body is fully deployed into ocean F. The above-described process is reversed for retrieval of the towed body 24 and stowage of the ramp 18.

Figure 5:
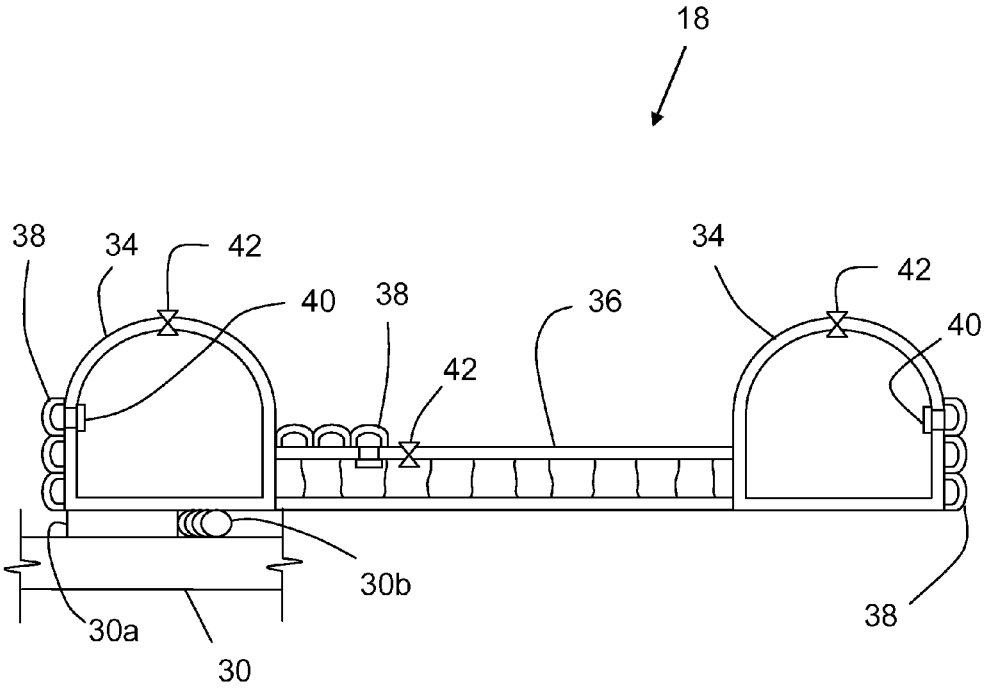
FIG. 5 is an enlarged, schematic cross-sectional view of an area in FIG. 3, showing a ramp component of the system.

Referring also to FIG. 5, there is shown an enlarged view of an area denoted as ellipse 5 in FIG. 3. FIG. 5 shows a schematic cross-sectional view of the ramp 18. For clarity of illustration, but not limitation, the bottom winch 22 is not shown in FIG. 5 and only a portion of the platform 30 is shown. The ramp 18 is connected to the platform 30 by rigid clamping fixture 30*a*. Dynamic snubber element 30*b* can be integrated into the fixture 30*a* to dampen out vibrations and transient tow loads. A dynamic snubber element is a mechanical element that operates in a similar fashion to a spring/dashpot system (i.e. a shock absorber). Depending on the construction, the dynamic snubber element dissipates kinetic energy through viscous or other forms of damping. The dynamic snubber minimizes undesirable motion between structural components such that system motions remain within operational limits.

The ramp 18 includes two arched shaped tubes 34, with flat panel 36 connected between the tubes. The tubes 34 can be fabricated of continuously circular braided material, reinforced with tensile webbing straps for shaping. As is known to those of skill in the art, tubes fabricated in this manner maintain their shapes when inflated. The panel 36 can be fabricated of woven spacer fabrics, also known as drop stitch fabrics. Such fabrics are known to those of skill in the art for use in inflatable boat decking.

For enhanced damage tolerance and puncture resistance; the skins of the drop stitch and tube fabrics would use dense woven architectures. For even greater damage tolerance and improved drop yarn strength; the use of crimp-imbalanced woven architectures are recommended in accordance with U.S. Pat. No. 8,555,472 and the progeny of this referenced patent. The tubes 34 and panel 36 can be protected from environmental exposure through the use of a laminated elastomeric coating, in the manner known to those skilled in the art.

The tubes 34 and panel 36 can be fabricated in multiple sections, such as sections 18*a*, 18*b*, 18*c*, 18*d* and 18*e*—as described with respect to FIGS. 2, 3 and 4. Each section can be pressurized independently of other sections through manifolded fill lines 38. Each section can include a fill port 40 connected to one of the fill lines 38. Each section can also include a pressure relief valve 42.

Figure 7:
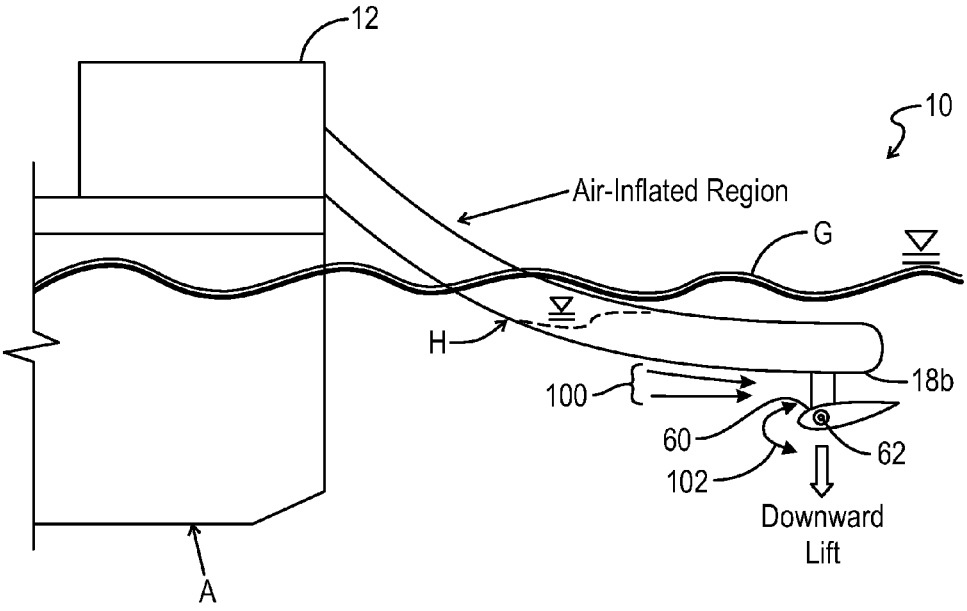
FIG. 7 is a schematic of a downward and lifting body for the ramp component of the system.

As shown in FIG. 7, a downward and lifting body 60 can be affixed to an underside of the ramp 18. The downward and lifting body 60 can be a passive or active control surface to perform as ballast for the ramp 18. As a passive control surface; the body 60 provides downward lift (a positive down depth) by allowing a flow 100 between the ramp 18 and the body. This flow or drag 100 assists in maintaining ballast on the rear section 18*b*; thereby, keeping a significant portion of the ramp 18 beneath a ballast depth H and the surface G. This positioning allows a vehicle to easily position above or on the top of the ramp 18.

The downward and lifting body 60 may also be controllable by allowing rotation 102 about an axis 62. Control can be based on depth with the use of a pressure sensor (not shown) and/or by sensing velocity thru the surface G. Active control can compensate for the buoyancy of the ramp 18. For a passive downward and lifting body 60; there is no rotation about the axis 62.

What has thus been described is a towed body launch and recovery system (10) having an inflatable ramp (18). The ramp (18) is lightweight and can be stowed in a standard shipping container (12) for ease of transport and to provide a universal deck footprint for the system. In addition to the ramp (18), the shipping container (12) houses the towed body (24), towed body handling system (26), tow cables (20*a* and 22*a*), winches (20 and 22) and winch controls (not shown). Furthermore, the container (12) includes power junctions (14) and air line connections (16). The system also includes power electronics and software controllers (not shown).

Multiple, inflatable, arch shaped tubes (34) and spacer fabric (36) form the ramp structure (18) from which the towed body (24) can be launched and recovered. Trailing end (rear) sections (18*b*) of the inflatable ramp (18) can be optionally ballasted to provide hydrodynamic stability against sea state motions and vessel wakes. The ballasted end sections (18*b*) also provide sufficient system depth below the surface to accommodate retrieval of towed bodies operating below the surface.

Connection of the forward inflated section (18*e*) to the vessel (A) can include a rigid clamping fixture (30*a*). The clamping fixture (30*a*) can include a dynamic snubber element (30*b*) that can dampen out vibrations and transient tow loads. The main air fill line (38) from the handling system (26) to the inflatable ramp (18) can be ported through the rigid clamping fixture (30*a*).

The foregoing description of the preferred embodiments of the invention has been presented for purposes of illustration and description only. It is not intended to be exhaustive or to limit the invention to the precise form disclosed; and obviously many modifications and variations are possible in light of the above teaching.

For example, space limitation within the container (housing) 12 can require power electronics and control software for the system 10 to be contained in one or more separate containers that can be connected between the vessel power supply C and the power fitting 14. Furthermore, the system 10 can be contained in any suitably sized structure other than a standard shipping container 12.

As a further example, the inflatable ramp 18 can be constructed solely of spacer fabrics, cylindrical arches, cylindrical beams, or any mixture thereof using any flexible material that can maintain a shape when inflated and subjected to anticipated loads. The number and types of independent air volumes, manifolding, ballasting methods, pressure relief mechanisms, fill ports, etc., can also be varied extensively.

Also, rather than passively ballasting the ramp 18 through submersion of the trailing end section 18*b*, the ballasting method can be actively controlled through the handling system 26. Additional hydrodynamic control of the ramp 18 can be achieved using control elements 18*g* located on the end section 18*b* (one of which is shown in phantom in FIG. 4). As alternatives, elements 18*g* can be fabricated as inflatable or rigid fin elements.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A launch and recovery system for a towed body, comprising:

a handling system for the towed body;

an inflatable ramp;

a container housing the towed body, said handling system and said inflatable ramp when said ramp is in a deflated configuration, the towed body attached to said handling system when said ramp is in the deflated configuration, said ramp inflated and extending from an aft end of said container and into a liquid medium in a deployed configuration, the towed body detached from said handling system and positioned on said ramp when said ramp is in the deployed configuration;

a first winch positioned within said container; and a first cable connected between said first winch and an aft end of said ramp, said first cable wound on said first winch when said ramp is in the deflated configuration such that said aft end is proximate to said first winch, said first cable unwound and extending away from said container when said ramp is in the deployed configuration such that said aft end is distant from said first winch.

2. The system of claim 1, further comprising:

a second winch positioned within said container; and a second cable connected between said second winch and a forward end of the towed body, said second cable wound on said second winch when the towed body is attached to said handling system such that said forward end is proximate to said second winch, said second cable unwound and extending away from said container when said towed body is maneuvered down said ramp in the deployed configuration such that the towed body is distant from said second winch and the towed body is deployed into the liquid medium.

3. The system of claim 2, further comprising a platform positioned within said container, a forward end of said ramp connected to said platform.

4. The system of claim 3, further comprising a snubber connection between said forward end and said platform.

5. The system of claim 3, wherein said platform is movably connected to said container, said platform positioned at a forward end of said container when said ramp is in the deflated configuration, said platform positioned at said aft end of said container when said ramp is in the deployed configuration.

6. The system of claim 5, wherein said second winch is attached to said platform.

7. The system of claim 5, wherein said first winch is movably connected to said container, said first winch positioned at said forward end of said container when said ramp is in the deflated configuration, said first winch positioned at said aft end of said container when said ramp is in the deployed configuration.

8. The system of claim 2, further comprising at least one ballast port in a trailing section of said ramp adjacent said aft end of said ramp;

wherein the liquid medium is capable of entering through said at least one ballast port and into said ramp when said ramp is in the deployed configuration such that said aft end of said ramp is below a surface of said medium when in the deployed configuration.

9. The system of claim 8, wherein said aft end of said ramp further comprises a drain for drainage of the liquid medium from within said ramp.

10. The system of claim 9, wherein said trailing section further comprises at least one of a hydrodynamic control element, an inflatable fin element, a rigid fin element, and a downward lifting surface.

* * * * *